United States Patent [19]

Sato et al.

[11] 4,411,749

[45] Oct. 25, 1983

[54] PROCESS FOR ELECTROLYZING AQUEOUS SOLUTION OF ALKALI METAL CHLORIDE

[75] Inventors: Kimihiko Sato; Yasuo Sajima; Makoto Nakao; Takeshi Morimoto, all of Yokohama, Japan

[73] Assignee: Asahi Glass Company Ltd., Tokyo, Japan

[21] Appl. No.: 294,786

[22] Filed: Aug. 20, 1981

[30] Foreign Application Priority Data

Aug. 29, 1980 [JP] Japan ..... 55-118461

[51] Int. Cl.[3] ..... C25B 1/34

[52] U.S. Cl. ..... 204/98; 204/128; 204/254; 204/256; 204/255; 204/283; 204/252

[58] Field of Search ..... 204/252, 254–256, 204/98, 128, 283

[56] References Cited

U.S. PATENT DOCUMENTS 4,029,565 6/1977 Bender et al. ..... 204/256

4,209,368 6/1980 Coker et al. ..... 204/98

*Primary Examiner*—R. L. Andrews

*Attorney, Agent, or Firm*—Oblon, Fisher, Spivak, McClelland & Maier

[57] ABSTRACT

A process for electrolyzing an aqueous solution of an alkali metal chloride by feeding said aqueous solution of an alkali metal chloride into the central space of a hollow quadrilateral frame holding an anode therein, defining an anode compartment, and feeding water or a dilute aqueous solution of an alkali metal hydroxide into the central space of a hollow quadrilateral frame holding a cathode therein, defining a cathode compartment, said anode compartment and said cathode compartment being separated by a cation exchange membrane, in a filter-press type electrolytic cell wherein:

(a) each hollow quadrilateral frame is provided with an inlet passage to the central space of said frame for the introduction of an electrolyte and an outlet passage from the central space of said frame for removal of an electrolyzed product;

(b) an anode or a cathode is held in each said frame and electrically connected to a power source or an adjacent counter electrode, each said anode or cathode being respectively made of a metal plate having at the central part thereof notched rectangular portions being alternatively bent to project in parallel to said metal plate and displaced therefrom, said notched rectangular portions being defined by adjacent longitudinal parallel cuts through said metal plate; and (c) a gas and liquid permeable non-electrode porous layer made of inorganic particles is formed on the cation exchange membrane in a thickness thinner than that of the membrane on at least one surface of said membrane, wherein said at least one surface of the cation exchange membrane having the porous layer thereon is separated from the anode or cathode facing said porous layer.

3 Claims, 3 Drawing Figures

PROCESS FOR ELECTROLYZING AQUEOUS SOLUTION OF ALKALI METAL CHLORIDE

BACKGROUND OF THE INVENTION

1. Field of the Invention

The present invention relates to a process for electrolyzing an aqueous solution of an alkali metal chloride. More particularly, it relates to a process for producing an alkali metal hydroxide by electrolyzing an aqueous solution of an alkali metal chloride in a low electric power consumption.

2. Description of the Prior Art

As a process for producing an alkali metal hydroxide and chlorine by electrolysis of an aqueous solution of an alkali metal chloride, a diaphragm method has been mainly employed instead of a mercury method in view of the prevention of pollution.

It has been proposed to use an ion exchange membrane in place of asbestos as a diaphragm to produce an alkali metal hydroxide by electrolyzing an aqueous solution of an alkali metal chloride so as to obtain an alkali metal hydroxide having high purity and high concentration.

On the other hand, it has been proposed to save energy in this world. From the viewpoint, it has been required to minimize the cell voltage in such technology.

It has been proposed to reduce cell voltage by improvements in the materials, compositions and configurations of an anode and a cathode and compositions of an ion exchange membrane and a kind of ion exchange group.

In these processes, certain advantages can be considered. However, in most of these processes, the maximum concentration of the alkali metal hydroxide is not so high. In the case of higher concentration over the critical concentration, the cell voltage is seriously increased or the current efficiency is remarkably lowered. The maintenance and durability of the low cell voltage phenomenon have not been satisfactory for an industrial purpose.

It has been proposed to reduce the cell voltage by decreasing the distance between electrodes. However, the decrease of the distance between an anode and a cathode with a cation exchange membrane therein is limited in the following aspects.

One aspect is as follows:

The cell voltage decreases depending upon a decrease of the distance between the electrodes to an average distance between the electrodes of about 3 mm, however, the cell voltage may increase by decreasing further the distance, because of an adhesion of bubbles, and residence of bubbles in a conventional combination of an expanded metal type anode and cathode.

The other aspect is as follows:

A flattening precision of a surface of an electrode results in the limitation. The flattening precision of the surface of the electrode depends upon size and the limitation is usually considered to be $\pm 1$ mm. In order to set a cation exchange membrane without damage, an average distance between electrodes of 1 mm or more is usually required. It is possible to decrease further the average distance between electrodes by improving the flattening precision of the surface of the electrode or providing a mechanism for absorbing the unevenness of the surface of the electrode in view of technology. However, serious labours and precise processing are required. Therefore, it is not advantageous in an industrial operation.

The inventors have studied to overcome these disadvantages and have found that the first problem can be solved by forming a thin porous layer on the cation exchange membrane and the second problem can be solved to attain a low cell voltage without increasing the flattening precision and decreasing an average distance between electrodes.

SUMMARY OF THE INVENTION

It is an object of the present invention to provide a process for electrolyzing an aqueous solution of an alkali metal chloride at a low cell voltage in an electrolytic cell which can be easily prepared without any serious consideration for precision under departing one surface of a cation exchange membrane having a non-electrode porous layer from an electrode.

The foregoing and other objects of the present invention have been attained by providing a process for electrolyzing an aqueous solution of an alkali metal chloride by feeding said aqueous solution of an alkali metal chloride into the central space of a hollow quadrilateral frame holding an anode therein, defining an anode compartment, and feeding water or a dilute aqueous solution of an alkali metal hydroxide into the central space of a hollow quadrilaterial frame holding a cathode therein, defining a cathode compartment, said anode compartment and said cathode compartment being separated by a cation exchange membrane, in a filter-press type electrolytic cell wherein:

(a) each hollow quadrilateral frame is provided with an inlet passage to the central space of said frame for the introduction of an electrolyte and an outlet passage from the central space of said frame for removal of an electrolyzed product;

(b) an anode or a cathode is held in each said frame and electrically connected to a power source or an adjacent counter cathode, each said anode or cathode being respectively made of a metal plate having at the central part thereof notched rectangular portions being alternately bent to project in parallel to said metal plate and displaced therefrom, said notched rectangular portions being defined by adjacent longitudinal parallel cuts through said metal plate; and (c) a gas and liquid permeable non-electrode porous layer made of inorganic particles is formed on the cation exchange membrane in a thickness thinner than that of the membrane on at least one surface of said membrane, wherein said at least one surface of the cation exchange membrane having the porous layer thereon is separated from the anode or cathode facing said porous layer.

DETAILED DESCRIPTION OF THE PREFERRED EMBODIMENTS

Figure 1:
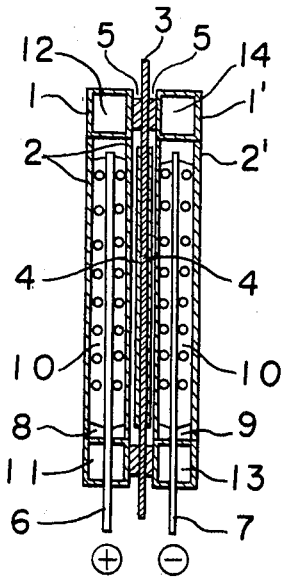
FIG. 1 is a partial sectional view of one embodiment of a filter-press type electrolytic cell having a quadrilateral hollow frame used for the process of the present invention.

In accordance with the process of the present invention, the increase of the cell voltage caused by the adhesion or residence of bubbles can be reduced and the cell voltage in an average distance between electrodes of 1 to 10 mm in a practical structure can be reduced for about 0.3 V at a current density of 20 A/dm$^2$.

The other advantage of the present invention in the practical operation is to give a low cell voltage only by setting the cation exchange membrane having the porous layer (formed by the following manner), as the setting of a conventional cation exchange membrane, without any other improvement of the conventional electrolytic cell (sometimes, using a thinner gasket placed between the frames for electrode compartment).

If the frames for electrode compartments are prepared in high precision and the elasticity of the gasket and the pressure for fastening the frames in the assembling are precisely controlled, it is possible to contact the porous layer with the electrode, however, the serious labour works and the precise processing are required for the purpose. Thus, it is advantageous to depart the porous layer from the electrode for a small distance by providing an average distance between the anode and the cathode of about 1 mm in the industrial operation. During the operation of the electrolysis, the surface of the cation exchange membrane approaches to the counter electrode, sometimes, contacts with it under the operation pressurizing to the anode side or the cathode side.

The gas and liquid permeable porous non-electrode layer made of inorganic particles formed on the surface of the cation exchange membrane can be formed by a substance having higher chlorine overvoltage or hydrogen overvoltage than that of an electrode which is placed near the porous layer, such as non-conductive substances.

The examples of the substance can be oxides, hydroxides, nitrides, carbides of Ti, Zr, Nb, Ta, V, Mn, Mo, Sn, Sb, W, Bi, In, Co, Ni, Be, Al, Cr, Fe, Ga, Ge, Se, Yt, Ag, La, Ce, Hf, Pb, Si, Th or rare earth metals or a mixture thereof.

It is preferable to use oxides, hydroxides, nitrides or carbides of Ti, Zr, Nb, Ta, V, Mn, Mo, Sn, Sb, W, Si or Bi because a stable function is maintained for a long time.

In order to form the porous layer from the substance, the particles made of the substance having a particle diameter of 0.01 to 100$\mu$ especially 0.1 to 50$\mu$ is used, if necessary, the particles are bonded with a suspension of a fluorinated polymer such as polytetrafluoroethylene. A content of the fluorinated polymer is usually in a range of 1.5 to 50 wt. % preferably 2.0 to 30 wt.%. If necessary, a suitable surfactant, a graphite or the other conductive material or additive can be used for uniformly blending them.

A content of the bonded particles for the porous layer on the membrane is preferably in a range of 0.01 to 30 mg/cm$^2$ especially 0.1 to 15 mg/cm$^2$.

The method of forming the porous layer on the ion exchange membrane can be the same as the method of forming a porous layer of electrode particles for an electrode, and can be the conventional method described in Japanese Unexamined Patent Publication No. 112398/1979 or a method of thoroughly blending the powder and, if necessary, a binder or a viscosity controlling agent in a desired medium and forming a porous cake on a filter by a filtration and bonding the cake on the ion exchange membrane. If the porous layer is a self-supportable layer, it is not always necessary to bond the porous layer on the membrane but also possible to contact the porous layer with the membrane.

The porous layer formed on the membrane usually has an average pore diameter of 0.01 to 2000$\mu$ and a porosity of 10 to 99% an air-permeability of $1\times10^{-5}$ mol/cm$^2$.min.cmHg or more. It is especially preferable to use the porous layer having an average pore diameter of 0.1 to 1000$\mu$ and a porosity of 20 to 95% an air-permeability of $1\times10^{-4}$ mol/cm$^2$.min.cmHg or more in view of a low cell voltage and a stable electrolysis operation.

A thickness of the porous layer is thinner than the thickness of the ion exchange membrane, and is precisely decided, depending upon the substance and physical properties thereof and is usually in a range of 0.01 to 100$\mu$, preferably 0.1 to 50$\mu$ especially 1 to 20$\mu$. When the thickness is out of the desired range, a desired low cell voltage is not attained or a removement of the gas or a movement of the electrolyte is disadvantageously inferior.

The substances for the anode and the cathode have low chlorine overvoltage or low hydrogen overvoltage.

The anode is usually made of a platinum group metal or alloy, a conductive platinum group metal oxide or a conductive reduced oxide thereof.

The cathode is usually a platinum group metal or alloy, a conductive platinum group metal oxide or an iron group metal or alloy.

The platinum group metal can be Pt, Rh, Ru, Pd, Ir. The iron group metal is iron, cobalt, nickel, Raney nickel, stabilized Raney nickel.

The active component for the electrode is coated on an expanded metal or a rectangular electrode substrate or is fabricated in the form of the electrode.

The cation exchange membrane on which the porous non-electrode layer is formed, can be made of a polymer having cation exchange groups such as carboxylic acid groups, sulfonic acid groups, phosphoric acid groups and phenolic hydroxy groups. Suitable polymers include copolymers of a vinyl monomer such as tetrafluoroethylene and chlorotrifluoroethylene and a perfluorovinyl monomer having an ion-exchange group such as sulfonic acid group, carboxylic acid group and phosphoric acid group or a reactive group which can be converted into the ion-exchange group. It is also possible to use a membrane of a polymer of trifluoroethylene in which ion-exchange groups such as sulfonic acid group are introduced or a polymer of styrene-divinyl benzene in which sulfonic acid groups are introduced.

The cation exchange membrane is preferably made of a fluorinated polymer having the following units $$(M)\ \left(CF_2-CXX'\right) \quad (M\ \text{mole}\ \%)$$

$$(N)\ \left(CF_2-\underset{\underset{Y-A}{|}}{CX}\right) \quad (N\ \text{mole}\ \%)$$

wherein X represents fluorine, chlorine or hydrogen atom or $-CF_3$; X' represents X or $CF_3(CF_2)_m$; m represents an integer of 1 to 5.

The typical examples of Y have the structures bonding A to a fluorocarbon group such as $$-(CF_2)_x-,\ -O-(CF_2)_x-,\ -(O-CF_2-\underset{\underset{Z}{|}}{CF})_y-,$$

$$-CF_2-(O-CF_2-\underset{\underset{Z}{|}}{CF})_y-,\ -(O-CF_2-\underset{\underset{Z}{|}}{CF})_x-(O-CF_2-\underset{\underset{Rf}{|}}{CF})_y-\ \text{and}$$

$$-O-CF_2-(\underset{\underset{Z}{|}}{CF}-O-CF_2)_x-(CF_2)_y-(CF_2-O-\underset{\underset{Rf}{|}}{CF})_z-$$

x, y and z respectively represent an integer of 1 to 10; Z and Rf represent —F or a $C_1$–$C_{10}$ perfluoroalkyl group; and A represents —COOM or —$SO_3M$, or a functional group which is convertible into —COOM or —$SO_3M$ by a hydrolysis or a neutralization such as —CN, —COF, —$COOR_1$, —$SO_2F$ and —$CONR_2R_3$ or —$SO_2NR_2R_3$ and M represents hydrogen or an alkali metal atom; $R_1$ represents a $C_1$–$C_{10}$ alkyl group; $R_2$ and $R_3$ represent H or a $C_1$–$C_{10}$ alkyl group.

It is preferable to use a fluorinated cation exchange membrane having an ion exchange group content of 0.5 to 4.0 milliequivalents/gram dry polymer especially 0.8 to 2.0 milliequivalence/gram dry polymer which is made of said copolymer.

In the cation exchange membrane of a copolymer having the units (M) and (N), the ratio of the units (N) is preferably in a range of 1 to 40 mol % preferably 3 to 25 mol %.

The cation exchange membrane used in this invention is not limited to be made of only one kind of the polymer. It is possible to use a laminated membrane made of two kinds of the polymers having lower ion exchange capacity in the cathode side, for example, having a weak acidic ion exchange group such as carboxylic acid group in the cathode side and a strong acidic ion exchange group such as sulfonic acid group in the anode side.

The cation exchange membrane used in the present invention can be fabricated by blending a polyolefin such as polyethylene, polypropylene, preferably a fluorinated polymer such as polytetrafluoroethylene and a copolymer of ethylene and tetrafluoroethylene.

The membrane can be reinforced by supporting said copolymer on a fabric such as a woven fabric or a net, a non-woven fabric or a porous film made of said polymer or wires, a net or a perforated plate made of a metal. The weight of the polymers for the blend or the support is not considered in the measurement of the ion exchange capacity.

The thickness of the membrane is preferably 20 to 500 microns especially 50 to 400 microns.

The porous non-electrode layer is formed on the surface of the ion exchange membrane preferably in the anode side and the cathode side by bonding to the ion exchange membrane which is suitable for bonding such as in a form of ion exchange group which is not decomposed, for example, an acid or ester form in the case of carboxylic acid group and —$SO_2F$ group in the case of sulfonic acid group, preferably under heating the membrane.

When the porous layer is formed on the cation exchange membrane, it is preferable to form the porous layers on both surfaces of the cation exchange membrane though it is not always necessary to form the porous layers on both surfaces but it is possible to form it only on one surface of the cation exchange membrane in the anode side or in the cathode side. The feature can be decided depending upon the position of the cation exchange membrane such as the position of the cation exchange membrane to shift it to the anode side or the cathode side and a distance between electrodes. For example, if the distance between electrodes is in a range of about 1 to 3 mm under the condition shifting the cation exchange membrane to the anode side, the gas formed between the cation exchange membrane and the anode is not easily removed and accordingly, it is preferable to form the porous layer on the surface of the cation exchange membrane to face the anode. In such structure, even though the distance between the cation exchange membrane and the anode is small, there is not a trouble of an increase of the cell voltage caused by the residence of the gas in the gap.

When the cation exchange membrane is placed to shift it to the cathode side, it is preferable to form the porous layer on the surface of the cation exchange membrane to face the cathode, in the same reason.

Referring to the drawings, embodiments of the electrolytic cell used for the process of the present invention will be illustrated.

FIG. 1 is a partial sectional view of one embodiment of a filter-press type electrolytic cell having a hollow quadrilateral frame. The references (1), (1') respectively designate hollow quadrilateral frames which are the hollow frame (1) for an anode compartment and the hollow frame (1') for a cathode compartment; the references (2), (2') respectively designate porous electrodes placed on both surfaces of the hollow frame. For example, the anode (2) is the conventional anode made of a titanium expanded metal coated with an anode active component such as a noble metal oxide and the cathode (2') is the conventional cathode made of a stainless steel expanded metal on which nickel and Raney nickel particles are coelectrodeposited. The reference (3) designates a cation exchange membrane and (4) designates a porous layer.

FIG. 1 shows the structure forming the porous layers on both surfaces of the cation exchange membrane. The frames for the anode and the cathode with the inserted gaskets (5) are fastened in the filter-press form. Conductive bars for anode (6) and conductive bars for cathode (7) are respectively inserted in the anode compartment (8) or the cathode compartment (9) through each bottom frame member of the chambers and are electrically connected to the electrode (2) or (2') held on each frame by each connecting part (10).

An elecrolyte is fed into the lower hollow member (11) of the hollow frame for anode (1) to feed it through fine holes (not shown) formed on the lower hollow member (11) into the anode compartment (8) so as to electrolyze it. The resulting gas and the unelectrolyzed solution are discharged through fine holes (not shown) formed on the upper hollow member (12) of the hollow frame and discharged through the upper hollow member (12) to the outside and a gas-liquid separation is carried out.

On the other hand, water or a dilute aqueous solution of an alkali metal hydroxide is fed into the lower hollow member (13) of the hollow frame for cathode (1') and is fed through fine holes (not shown) formed on the lower hollow member into the cathode compartment (9). The resulting hydrogen gas and the aqueous solution of an alkali metal hydroxide are discharged through fine-holes (not shown) formed on the upper hollow frame member (14) of the hollow frame and is discharged through the upper hollow member (14) to the outside and a gas-liquid separation is carried out.

Figure 2:
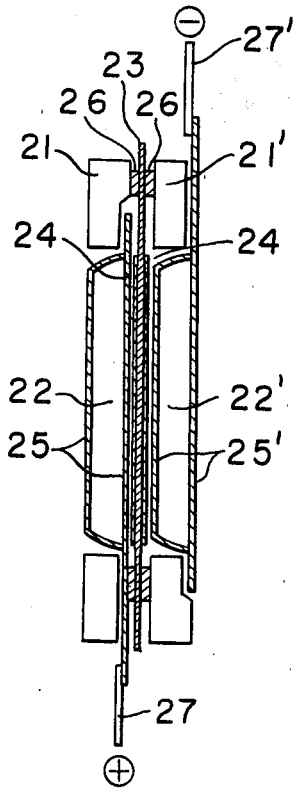
FIG. 2 is a partial sectional view of one embodiment of a filter-press type electrolytic cell having a non-conductive platy frame used for the process of the present invention.

FIG. 2 is a partial sectional view of one embodiment of filter-press type electrolytic cell having non-conductive platy frames used for the process of the present invention. The references (21), (21') respectively designate a frame for anode and a frame for cathode which are made of a non-conductive substance such as a fluorinated resin or a fiber reinforced plastic. The platy frame has each space (22) or (22') as an anode compartment or a cathode compartment. The space can be formed by cutting the center part of a plate. The reference (23) designates a cation exchange membrane; and (24) designates porous layers formed on both surfaces of the membrane. The anode (25) and the cathode (25') are prepared by the below-mentioned process. Each gasket (26) is inserted between the frame for anode and the frame for cathode and the frames are fastened in the filter-press form. The electrodes are respectively electrically connected through bus-bars to a terminal (27) for the anode and a terminal (27') for the cathode at the outside of the frames. Each liquid inlet (not shown) and each gas-liquid outlet (not shown) are formed on each frame for anode or cathode. The inlet and the outlet are connected to the central space for the anode compartment or the cathode compartment.

Figure 3:
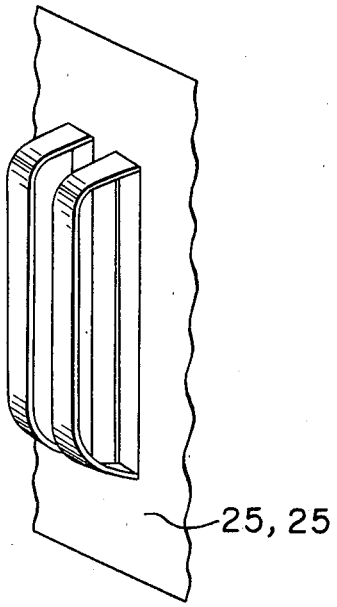
FIG. 3 is a schematic view of an electrode used in FIG. 2.

FIG. 3 is a schematic view of one embodiment of the electrode used for the cell shown in FIG. 2. Both the anode and the cathode have the same configuration shown in FIG. 3. Thus, the anode shown in FIG. 3 will be illustrated. The anode (25) is prepared by notching in each parallel rectangular form in the longitudinal direction with each space of about 1 to 15 mm on the central part of a titanium flat sheet. The notched rectangular parts are alternately outwardly projected in the form shown in FIG. 3. A conventional anode active component such as an oxide of a platinum group metal is coated on the surface of the fabricated titanium sheet to obtain the anode (25). In the preparation, parallel cut parts (both ends of the cut parts are not extended to the peripheral parts of the plate) are formed and the parallel cut parts are alternately outwardly pressed to form non-cut projected parts (top parts are parallel to the base plate as shown in FIG. 3.

When the anode and the cathode shown in FIG. 3 are arranged to assemble the electrolytic cell shown in FIG. 2, the anode and the cathode shown in FIG. 3 are arranged by partitioning with the cation exchange membrane having the porous layer. It is preferable to arrange each projected rectangular part of one electrode shown in FIG. 3 to face the concave rectangular part of the adjacent electrode. It is not necessary to completely fit them but it is possible to slightly shift the electrode so as to partially face the projected part of the electrode to the flat part of the adjacent electrode.

The process of the present invention can be carried out in a filter-press type monopolar electrolytic cell or a filter-press type bipolar electrolytic cell.

In the present invention, the process condition for the electrolysis of an aqueous solution of an alkali metal chloride can be the known condition in the prior art as described in Japanese Unexamined Patent Publication No. 112398/1979.

For example, an aqueous solution of an alkali metal chloride (2.5 to 5.0 Normal) is fed into the anode compartment and water or a dilute aqueous solution of an alkali metal hydroxide is fed into the cathode compartment and the electrolysis is preferably carried out at 80 to 120° C. and at a current density of 10 to 100 A/dm$^2$.

In this case, the presence of heavy metal ion such as calcium or magnesium ion in the aqueous solution of an alkali metal chloride causes deterioration of the ion exchange membrane, and accordingly it is preferable to minimizes the content of the heavy metal ion. In order to prevent the generation of oxygen on the anode, it is preferable to feed an acid in the aqueous solution of an alkali metal chloride.

The present invention will be further illustrated by certain examples and references which are provided for purposes of illustration only and are not intended to limit the present invention.

EXAMPLE 1

In 50 ml. of water, 73 mg. of tin oxide powder having a particle diameter of less than 44μ was dispersed. A suspension of polytetrafluoroethylene (PTFE) (Teflon 30 J manufactured by DuPont) was added to give 7.3 mg. of PTFE. One drop of nonionic surfactant was added to the mixture. The mixture was stirred under cooling with ice and was filtered on a porous PTFE sheet under suction to obtain a porous layer. The thin porous layer had a thickness of 30μ, a porosity of 75% and a content of tin oxide of 5 mg./cm$^2$.

On the other hand, in accordance with the same process, a thin layer having a particle diameter of less than 44μ, a content of nickel oxide of 7 mg/cm$^2$, a thickness of 35μ and a porosity of 73% was obtained.

Both the thin layers were superposed on a cation exchange membrane made of a copolymer of $CF_2=CF_2$ and $CF_2=CFO(CF_2)_3COOCH_3$ having an ion exchange capacity of 1.45 meq./g. resin and a thickness of 250μ without contacting the porous PTFE face to the cation exchange membrane and they were pressed at 160° C. under a pressure of 60 kg./cm$^2$ to bond the thin porous layers to the cation exchange membrane and then, the porous PTFE sheets were peeled off to obtain the cation exchange membrane on both surfaces of which the tin oxide porous layer and the nickel oxide porous layer were respectively bonded.

The cation exchange membrane having the layers on both sides was hydrolyzed by dipping it in 25 wt. % aqueous solution of sodium hydroxide at 90° C. for 16 hours.

Over the open faces of a hollow quadrilateral frame made of titanium, a titanium expanded metal coated with ruthenium oxide as the anode active component (a thickness of 1.5 mm; a width of 1.8 mm; and an area of each opening 20 mm$^2$) was fixed.

Over the open faces of a hollow quadrilateral frame made of stainless steel, a stainless steel expanded metal treated by sodium hydroxide (a thickness of 1.9 mm; a width of 1.9 mm; and an area of each opening of 24 mm$^2$) was fixed.

The filter-press type electrolytic cell shown in FIG. 1 was assembled by using the former frame as the anode frame and the latter frame as the cathode frame and inserting the cation exchange membrane having the porous layers, and each gasket between the frames to give 3 mm of an average distance between the anode and the cathode.

An aqueous solution of sodium chloride was fed to maintain an anolyte concentration of 200 g/liter and water was fed into the cathode compartment and an electrolysis was performed under the following condition:

Current density: 20 A/dm$^2$
Temperature in cell: 90° C.
Concentration of NaOH in catholyte: 35 wt.%
A voltage between electrodes was 2.90 V and a current efficiency was 95%.

EXAMPLE 2

In accordance with the process of Example 1 except providing 1 mm of an average distance of the anode and the cathode by improving the precision for processing the anode and the cathode to be ±0.5 mm, an electrolysis was performed.

As a result, a voltage between electrodes was 2.89 V.

REFERENCE 1

In accordance with the process of Example 1 except using the cation exchange membrane which did not have any porous layer, an electrolysis was performed. As a result, a voltage between electrodes was 3.17 V and a current efficiency was 94.5%.

REFERENCE 2

In accordance with the process of Example 2 except using the cation exchange membrane which did not have any porous layer, an electrolysis was performed. As a result, a voltage between electrodes was 3.32 V and a current efficiency was 94.5%.

EXAMPLE 3

A titanium substrate for electrode shown in FIG. 3 (an projected width of 6 mm) was prepared by forming notches with each space of 3 mm at the center part of a titanium sheet having a thickness of 1 mm and bending alternately the notched parts in one side of the titanium sheet and it was coated with ruthenium oxide to obtain an anode.

In accordance with the same process, a stainless steel sheet having a thickness of 1 mm was notched and bent to form a substrate for electrode shown in FIG. 3 and the substrate was treated with sodium hydroxide to obtain a cathode.

The filter-press type electrolytic cell shown in FIG. 2 was assembled by inserting the cation exchange membrane having the porous layers prepared in Example 1 between the anode and the cathode to give 3 mm of a distance between the flat part of the anode and the projected part of the cathode and using a frame made of a fluorinated resin. In the arrangement of the anode and the cathode, the projected parts of the cathodes were respectively face the rectangular spaces.

In accordance with the process of Example 1 except using the electrolytic cell, an elecrolysis was performed under the same condition. As a result, a voltage between electrodes was 2.92 V and a current efficiency was 94.5%.

We claim:

1. A process for electrolyzing an aqueous solution of an alkali metal chloride by feeding said aqueous solution of an alkali metal chloride into the central space of a hollow quadrilateral frame holding an anode therein, defining an anode compartment, and feeding water or a dilute aqueous solution of an alkali metal hydroxide into the central space of a hollow quadrilateral frame holding a cathode therein, defining a cathode compartment, said anode compartment and said cathode compartment being separated by a cation exchange membrane, in a filter-press type electrolytic cell wherein:

(a) each hollow quadrilateral frame is provided with an inlet passage to the central space of said frame for the introduction of an electrolyte and an outlet passage from the central space of said frame for removal of an electrolyzed product;

(b) an anode or a cathode is held in each said frame and electrically connected to a power source or an adjacent counter electrode, each said anode or cathode being respectively made of a metal plate having at the central part thereof notched rectangular portions being alternately bent to project in parallel to said metal plate and displaced therefrom, said notched rectangular portions being defined by adjacent longitudinal parallel cuts through said metal plate; and (c) a gas and liquid permeable non-electrode porous layer made of inorganic particles is formed on the cation exchange membrane in a thickness thinner than that of the membrane on at least one surface of said membrane, wherein said at least one surface of the cation exchange membrane having the porous layer thereon is separated from the anode or cathode facing said porous layer.

2. The process according to claim 1, wherein said filter-press type electrolytic cell is a monopolar or bipolar type electrolytic cell.

3. The process according to claim 1 or 2, wherein said non-electrode porous layer is made of inorganic particles having a particle diameter of 0.01 to 100 microns; has an average pore diameter of 0.01 to 2000 microns; has a porosity of 10 to 99%; and a thickness of 0.01 to 100 microns.

* * * * *